United States Patent [19]

Huang

[11] Patent Number: 4,998,655

[45] **Date of Patent: * Mar. 12, 1991**

[54] REUSABLE DISPENSER FOR PACKAGING TAPES, AND COMBINATION DISPENSER AND TAPE ROLL

[75] Inventor: Harrison Huang, Shenkang Shiang, Taiwan

[73] Assignee: Sunclipse, Inc., Montebello, Calif.

[ * ] Notice: The portion of the term of this patent subsequent to Apr. 17, 2007 has been disclaimed.

[21] Appl. No.: 64,143

[22] Filed: Jun. 18, 1987

[51] Int. Cl.[5] ..... B65D 85/672; B65H 35/07

[52] U.S. Cl. ..... 225/26; 225/47; 225/48

[58] Field of Search ..... 225/46–49, 225/54, 65, 66, 39, 25, 26; 242/55.2, 55.53; 206/397, 398, 303, 408

[56] References Cited

U.S. PATENT DOCUMENTS

| | | | |
|---|---|---|---|
| D. 300,750 | 4/1989 | Mead | D19/67 |
| 2,295,477 | 9/1942 | Jackson | 225/66 |
| 2,295,679 | 9/1942 | Montbach | 225/66 |
| 2,309,396 | 1/1943 | Jackson | 206/52 |
| 2,664,252 | 12/1953 | Glew | 225/66 |
| 2,987,232 | 6/1961 | Burdick et al. | 255/26 |
| 2,992,727 | 7/1961 | Zeitter | 206/52 |
| 3,613,973 | 10/1971 | Jaeschke | 225/47 |
| 3,815,801 | 6/1974 | Perrin | 225/47 |
| 3,913,786 | 10/1975 | Kartasuk | 221/70 |
| 4,042,168 | 8/1977 | Kasel et al. | 229/40 |
| 4,291,801 | 9/1981 | Basili et al. | 206/387 |
| 4,339,035 | 7/1982 | Marcus et al. | 206/370 |
| 4,417,677 | 11/1983 | Mead | 225/26 |
| 4,496,048 | 1/1985 | Sykes | 206/387 |
| 4,627,560 | 12/1986 | Samuelson | 225/65 |
| 4,817,798 | 4/1989 | Huang | 206/411 |

FOREIGN PATENT DOCUMENTS

| | | | |
|---|---|---|---|
| 2827185 | 1/1979 | Fed. Rep. of Germany | 206/411 |
| 377091 | 8/1907 | France | 225/66 |
| 150234 | 3/1955 | Sweden | 206/411 |
| 645997 | 11/1950 | United Kingdom | 225/66 |

*Primary Examiner*—Hien H. Phan

*Attorney, Agent, or Firm*—Poms, Smith, Lande & Rose

[57] ABSTRACT

A synthetic resin dispenser for dispensing packaging tape, having thin flexible sidewalls adapted to receive between them a roll of packaging tape. Bearing elements are provided and extend part way into the opening in the core of the tape roll, the bearing elements being integral with the sidewalls and having inclined cam surfaces adapted to cam the sidewalls apart. The dispenser further comprises integral synthetic resin ridges to prevent the tape from sticking to the dispenser, and which are adjacent a serrated metal blade embedded in the synthetic resin generally perpendicular to the direction of tape feed.

16 Claims, 3 Drawing Sheets

FIG. 7.
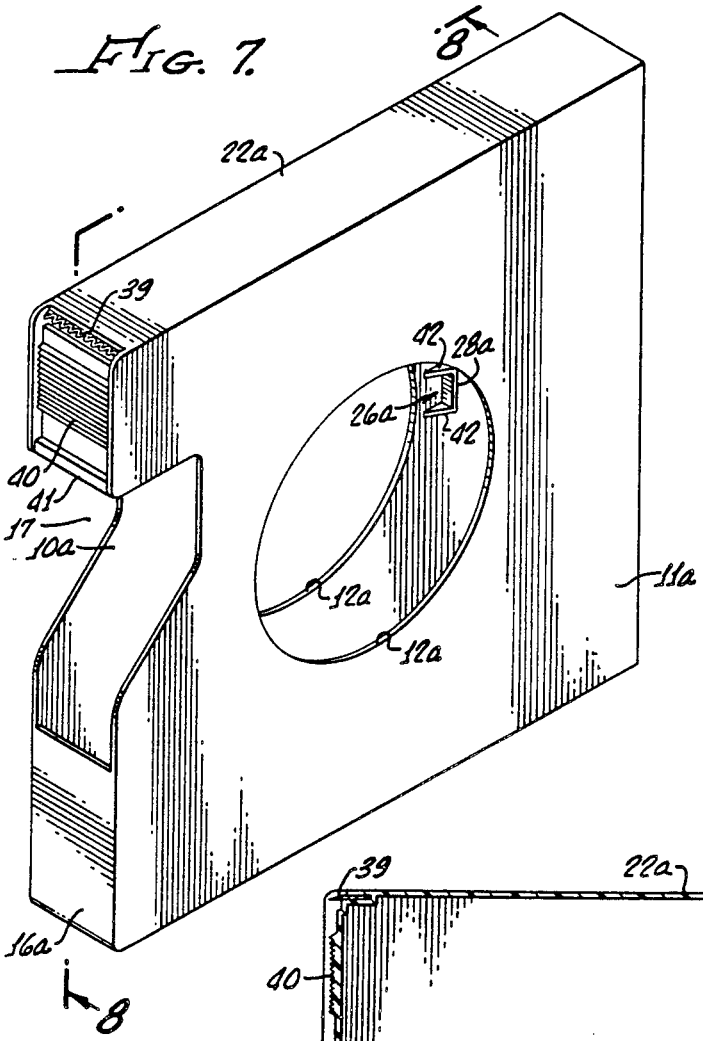
FIG. 9.
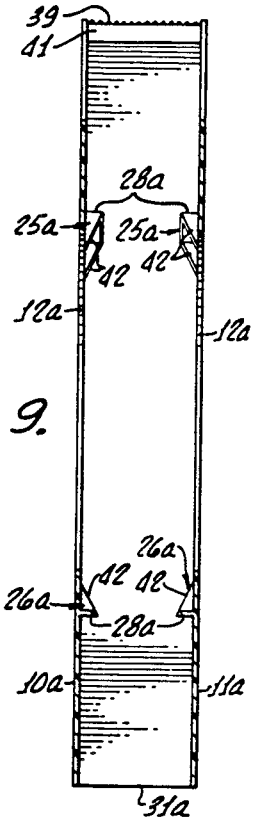
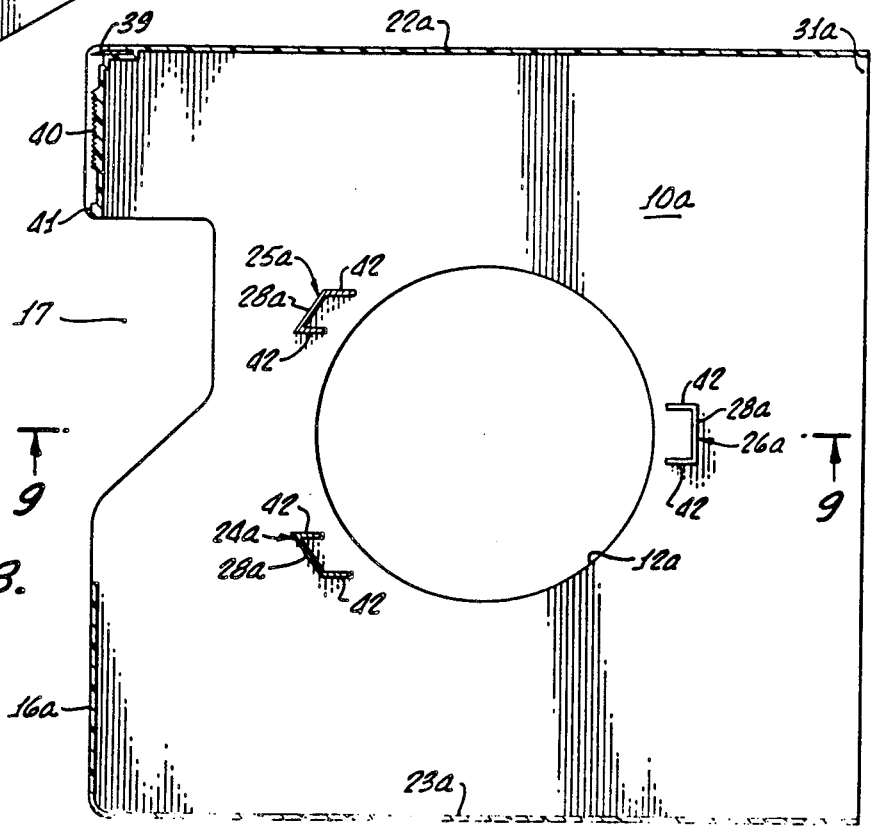
FIG. 8.

REUSABLE DISPENSER FOR PACKAGING TAPES, AND COMBINATION DISPENSER AND TAPE ROLL

BACKGROUND OF THE INVENTION

Prior tape dispensers of the rectangular container type were often formed of cardboard, and were characterized by the absence of well-defined free-sliding bearing surfaces for the core of the tape roll. Many of such dispensers were not practical to reuse, and were especially impractical for numerous reuses. It was conventional in such devices to fold cardboard flaps into the interior of the tape roll, so that such flaps could achieve a partial roll-stabilizing function.

SUMMARY OF THE INVENTION

There has now been invented, and is in substantial commercial production, a tape dispenser and combination that is almost infinitely reusable, that incorporates free-sliding and effective bearing means for the interior surface of the tape roll core, that can be loaded and unloaded rapidly and with ease, and yet which makes it very simple, convenient and practical to stop tape-roll rotation—in several ways—when severing is required.

The present tape dispenser is economically formed by injection molding a synthetic resin.

There are provided, on the interior of the synthetic-resin dispenser, inwardly-projecting bearing ears between which the tape roll snaps during loading and unloading through an open side of the dispenser. After the roll is snapped into position, the ears serve as smooth bearing surfaces that afford low-friction bearing support for the roll as the tape is dispensed therefrom. When severing is desired, the operator has a variety of ways to prevent the tape roll from rotating. These include using his fingertips to press the roll against an interior surface of the dispenser, using the sides of his fingers to squeeze on the dispenser so that it provides a braking force against the sides of the roll, and using his thumb to press down on the roll and thus lock it against the bearing ears.

The bearing ears are cam shaped on one side so as to facilitate insertion and/or removal of the tape roll. The dimensions of the roll are correlated to the interior dimensions of the container, and to the bearing ears, in such manner that only a small amount of bending of the dispenser is required for loading and unloading of the roll. Such bending is totally harmless to the dispenser since it is formed of elastic synthetic resin that immediately resumes its original shape after the bending action has terminated.

The bearing ears are so located that the mold elements forming the dispenser can be simple and relatively low in cost. Furthermore, such bearing elements are not located at equally-spaced positions relative to each other, there instead being two at the top and only one at the bottom. This arrangement of the bearing ears not only reduces mold costs but permits the tape roll to move horizontally farther than it can move vertically, thus permitting the roll to be shifted against one side of the dispenser to thus brake rotation of the roll.

BRIEF DESCRIPTION OF THE DRAWINGS

FIG. 7 is an isometric view of second embodiment of the invention;

FIG. 8 is a sectional view on line 8—8 of FIG. 7; and

FIG. 9 is a sectional view on line 9—9 of FIG. 8.

DETAILED DESCRIPTION OF THE PREFERRED EMBODIMENTS

Figure 1:
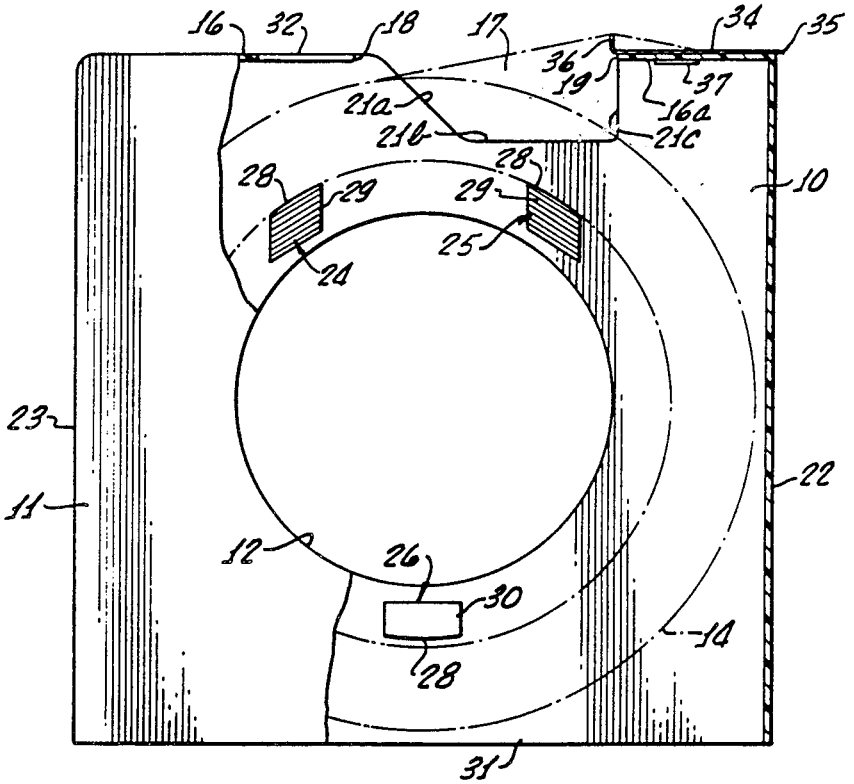
FIG. 1 is a side view of the combination tape dispenser and tape roll, portions being broken away, the roll being shown by phantom lines.

Referring to the drawings, the tape dispenser is a hollow polyhedron having opposed and substantially parallel walls that are preferably rectangular or square. Except for the cutting blade described subsequently, the dispenser is formed of synthetic resin, and its walls are thin and flexible. The walls have sufficient elasticity that, after they have been flexed somewhat during insertion or removal of a roll of packaging tape, they will immediately resume their normal flat condition.

Referring to FIGS. 1 and 4–6, the tape dispenser has sidewalls 10, 11 substantially parallel to each other. Each sidewall 10, 11 is preferably square, and each has a central circular opening 12 therein. The diameter of each opening 12 is substantially smaller than the inner diameter of the cylindrical cardboard core of the roll 14 of packaging tape that is mounted in the tape dispenser. The packaging tape is, for example, transparent synthetic resin tape having pressure-sensitive adhesive on one side.

Figure 4:
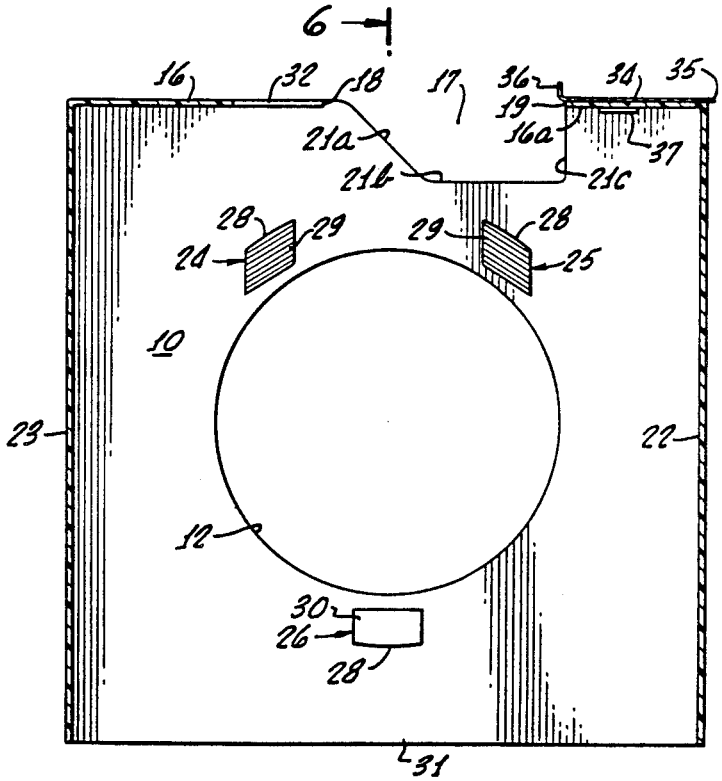
FIG. 4 is a vertical sectional view of the dispenser shown in FIG. 1, the tape roll being unshown.

The tape dispenser has a top wall that is formed of two coplanar portions **16, 16*a* separated by a dispensing opening 17. The dispensing opening 17 is defined not only by the opposed edges 18, 19 of top wall portions 16, 16*a*, but also by edge regions of cut-out portions of sidewalls 10, 11. Referring especially to FIG. 4, such edge regions have downwardly-inclined portions 21*a* near edge 18, also have horizontal portions 21*b*, and further have vertical portions 21*c* that extend up to edge 19**.

The tape dispenser further has a forward wall 22 and a rear wall 23, these walls being parallel to each other and preferably solid. On the other hand, the bottom of the dispenser, that is to say the portion thereof remote from wall portions **16, 16*a*, is open so that the tape roll 14** with its core may be introduced therethrough, and so that the core may be removed therethrough after the packaging tape has been dispensed.

Provided on the interior surfaces of sidewalls 10, 11 are bearing ears 24–26. Preferably, such ears 24–26 are integral with the respective sidewalls 10, 11, and are thus formed of the same synthetic resin. Each such ear has an outer surface 28 (FIG. 6) that extends perpendicularly to the associated sidewall 10, 11 and that is adapted to engage in sliding fashion the interior surface of the core of tape roll 14.

Two of the bearing ears on each sidewall, namely numbers 24 and 25, are relatively near top wall **16, 16*a* and the dispensing opening 17. Such ears 24, 25 have inclined cam surfaces 29 (FIG. 6) that converge toward their associated walls 10, 11, also toward openings 12, and also toward the open bottom of the dispenser, the opening at the bottom of the dispenser bottom being numbered 31**.

The remaining bearing ears, numbered 26, are relatively near the bottom opening 31. They have inclined cam surfaces 30 that converge toward their associated walls 10, 11 and also toward the openings 12 thereabove.

In the illustrated preferred form, the bearing ears 24–26 are not equally spaced about the circumferences of sidewall openings 12. Instead, the upper ears 24, 25 are relatively close together, while being spaced large distances from the bottom ears 26.

Figure 5:
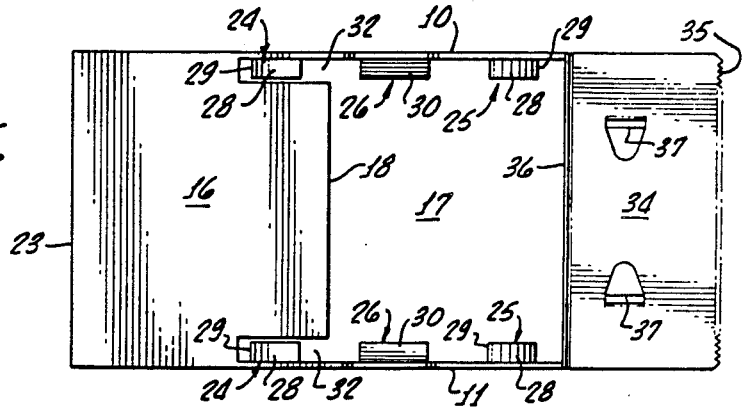
FIG. 5 is a top plan view of the showing of FIG. 4.
Figure 6:
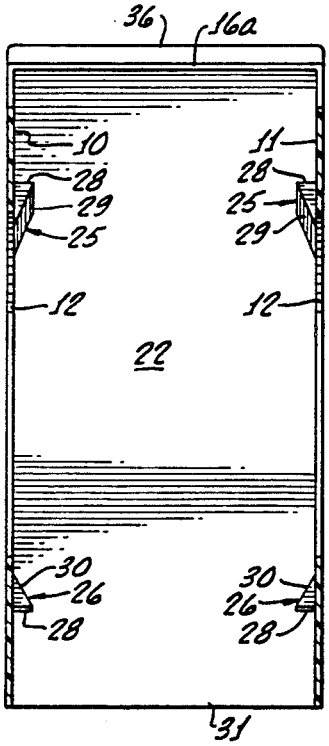
FIG. 6 is a vertical sectional view taken on line 6—6 of FIG. 4.

Referring to FIGS. 4 and 5, the dispensing opening 17 has extensions 32 that are respectively adjacent sidewalls 10, 11 and that extend rearwardly from opposite ends of edge 18. These extensions of opening 17 have widths greater than the dimensions of ears 24–26 in a direction perpendicular to sidewalls 10, 11. Thus, the molds employed in the molding of the tape dispenser can and are shaped to simultaneously form the opening extensions 32 and the ears 24–26. The extensions 32 further increase the flexibility of the upper portions of sidewalls 10, 11, so that such sidewalls may be bent in opposite directions during insertion and removal of the tape roll and core.

As best shown in FIG. 4, the lower bearing ears 26 are in a vertical plane lying between vertical planes containing the upper bearing ears 24, 25. Accordingly, all of the bearing ears 24–26 may be, and are, molded simultaneously by mold elements portions of which extend through the bottom opening 31 and through the dispensing opening 17 and its extensions 32.

The sizes and locations of bearing ears 24–26, and the size of the chamber defined within the tape dispenser, are correlated to the size of tape roll 14 and its core. The relationships are such that the tape roll is loosely mounted in the dispenser, both relative to the dispenser walls and relative to the bearing ears. Examples will now be given by way of illustration.

Let it be assumed that the inner diameter of the tape-roll core is about 3 inches, and that the width of the tape (and thus the width of the tape roll) is about $1\frac{7}{8}$ inches. For such a roll, the bearing surfaces (outer surfaces) 28 of the bearing ears are located around a circle having a diameter of about $2\frac{7}{8}$ inches. Thus, when the free end of the tape on roll 14 is passed through dispensing opening 17 and then pulled, the inner cylindrical surface of the core of the tape roll rides freely and smoothly on outer bearing surfaces 28 of bearing ears 24–26 (riding especially on the surfaces 28 of ears 24, 26). During such dispensing, there is no binding against the sides of the tape roll, due to the clearances stated below, and because the operator is advised not to squeeze on the dispenser during tape dispensing.

Figure 2:
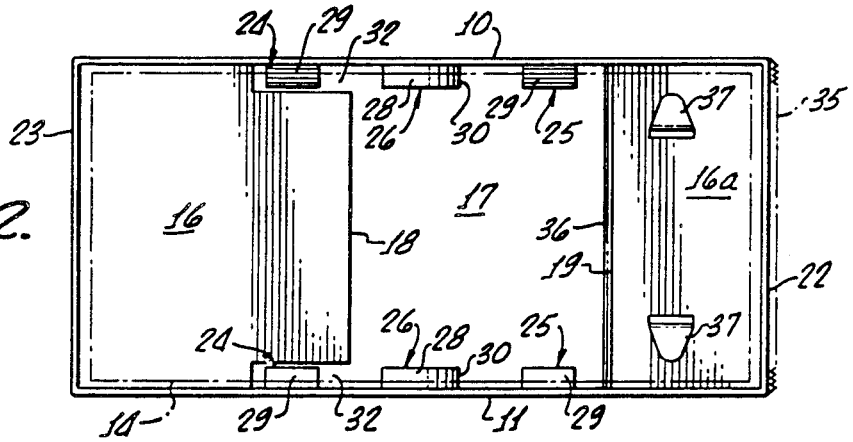
FIG. 2 is a bottom view of the showing of FIG. 1.

Referring to FIG. 2, the width of the chamber within the dispenser is about 2 inches when the tape roll has the exemplary width of about $1\frac{7}{8}$ inches. In the present example, the dimensions of outer bearing surfaces 28 perpendicularly to their associated sidewalls 10, 11 are about $\frac{1}{8}$ inch. The various dimensions are such that the tape roll will remain on the bearing ears at all times except when the operator is intentionally effecting insertion or removal of the roll. On the other hand, there is relatively little overlap between the bearing surfaces and the interior cylindrical surface of the tape-roll core, which facilitates both insertion of the tape roll and removal of the core.

Proceeding next to a description of the means for severing the tape after it is dispensed, and also for preventing the severed end from adhering too closely to the dispenser, this comprises a thin metal plate 34 having a serrated edge 35 and a flange 36. There are also mounting ears 37 provided on plate 34 and that extend through openings in top wall portion **16*a* and are bent so as to hold the plate in position. For a further description of this severing means, which (very importantly) keeps the severed end of the tape from adhering too closely to the dispenser after severing, reference is made to U.S. Pat. No. 4,417,677, element 40**. The description relative to such element contained in such patent is hereby incorporated by reference herein.

Referring next to FIGS. 7–9, there is shown another embodiment of the present invention. Such embodiment is, in the illustrated example, adapted to contain a less wide but larger diameter tape roll than is the embodiment of FIGS. 1–6. Such roll is, often, filament tape. The embodiment of FIGS. 7–9 is identical to that of FIGS. 1–6 except as specifically described in the next two paragraphs. The reference numerals on FIGS. 7–9 are the same as those of FIGS. 1–6, except that each reference numeral is followed by the letter "a" except relative to changed portions. In FIGS. 7–9, there are no opening extensions 32; instead, the entire dispensing opening 17 is made larger.

As shown at the upper-left of FIG. 7, the severing means is a small serrated metal blade 39 embedded in the synthetic resin and lying substantially the same plane as that of wall **22*a*. The means for preventing the severed end of the tape from adhering too closely to the dispenser is not a separate metal plate but instead a closely ridged portion 40 formed integrally of synthetic resin during the molding of the entire dispenser. The flange 41** is also not formed of metal but instead is formed integrally of synthetic resin during the molding process.

The bearing ears differ from those described relative to the previous embodiment in that each ear does not have a single inclined cam surface (such as 29, 30) but instead has inclined camming and supporting walls. These inclined walls, which converge toward their associated dispenser sidewalls **10*a*, 11*a*, and toward the central circular openings 12*a*, and numbered 42 in FIGS. 8 and 9**.

OPERATION

Referring again to FIGS. 1–6, which is the preferred embodiment, the operation of the tape dispenser combination will be described.

Figure 3:
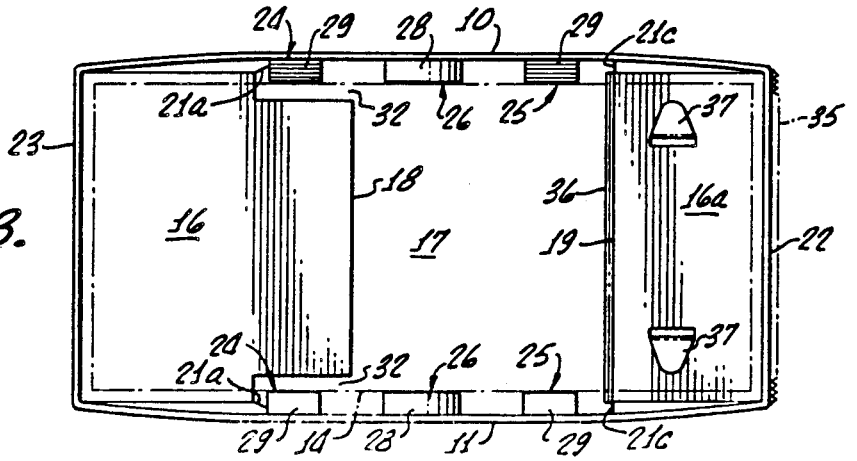
FIG. 3 is a view corresponding to FIG. 2 but illustrating the bending of the sides of the dispenser when the roll is shifted in or out.

The operator takes the roll of packaging tape 14 and inserts it through opening 31 until its upper region is adjacent the bottom bearing ears 26. Then, or at the same time that insertion occurs, the operator pulls slightly apart the opposed walls 10, 11, and simultaneously further inserts the tape roll past the now-retracted bearing ears 26. Reference is made to FIG. 3. The operator then continues the insertion of the tape roll, causing the periphery of the roll to engage the cam surfaces 29 of upper ears 24, 25 and thus cam the adjacent portions of sidewalls 10, 11 apart. The roll snaps over the bearing ears 24, 25, so that the tape roll comes into a rest position at which the interior cylindrical surface of the core is adjacent all three bearing surfaces 28 of the ears on each wall 10, 11.

Then, the operator pulls on the free end of the tape and causes it to pass through dispensing opening 17.

The free end of the tape is then caused to rest on the plate 34. When it is desired to use the tape for packaging or other purposes, the operator removes the free end of the tape from the plate 34 and causes it to adhere to the package. Then, the operator holds the dispenser loosely, and pulls on the dispenser while permitting the tape roll 14 to rotate freely on bearing surfaces 28.

When a desired amount of tape has been dispensed, the operator brakes the roll by, for example, using his or her fingers to push the interior surface of the core rearwardly until the exterior surface of the roll engages rear wall 22 and brakes thereagainst. It is to be understood that the operator's fingers are inserted through the openings 12 in sidewalls 10, 11. At other times, for example when there is relatively little tape on the roll, the operator can squeeze the sidewalls 10, 11 against the tape roll and thus create a braking action, or can brake by pressing his or her thumb downwardly on the tape roll at dispensing opening 17.

The roll being braked, the operator merely lifts upwardly on the dispenser to cause serrated edge 35 to sever the tape.

After the complete roll has been dispensed, and only the core remains, the operator manually spreads the upper regions of sidewalls 10, 11 apart a slight distance to permit the core to pass between bearing ears 24, 25. The operator then pulls downwardly on the core until it cams against cam surfaces 30 of bearing ears 26 and thus spreads apart the lower regions of walls 10, 11, so that the core passes therebetween.

A new roll of tape is then inserted as described above, and the process can be repeated relative to any number of rolls of tape.

The foregoing detailed description is to be clearly understood as given by way of illustration and example only, the spirit and scope of this invention being limited solely by the appended claims.

What is claimed is:

1. A dispenser for packaging tape, comprising:

(a) wall means to define a chamber sized to loosely receive a roll of packaging tape, said wall means being formed of synthetic resin, said wall means forming a polyhedron having opposed substantially parallel sidewalls and having front and rear walls substantially parallel to each other and extending between said sidewalls, said polyhedron also having a top wall, said sidewalls being sufficiently thin to be flexible and elastic, a portion of said wall means between said sidewalls having an opening therein, the bottom of said polyhedron being open to provide said opening, said opening being so located and sized that said tape roll may be passed therethrough, in a direction parallel to said sidewalls, to a position in said chamber between said sidewalls, (b) bearing elements mounted on said opposed sidewalls and extending inwardly therefrom, said bearing elements being adapted to extend part way into the opening in the core of said tape roll, and to provide bearing support for said roll as tape is dispensed therefrom, the amount of said inward extension of said bearing elements being sufficiently small that, when said sidewalls are manually flexed apart, said tape roll may be inserted through said opening into said chamber, said tape roll passing between the inner portions of said bearing elements, said bearing elements penetrating, after said flexed sidewalls resume their unflexed conditions, into the opening in the core of said tape roll, (c) dispensing opening means in said wall means, through which tape may be dispensed from said roll, said dispensing opening means being contained in said top wall, and (d) means on said wall means to sever the tape after a length of tape has been dispensed from said roll.

2. The invention as claimed in claim 1, in which there are a plurality of said bearing elements on each of said sidewalls.

3. The invention as claimed in claim 1, in which there are at least three of said bearing elements on each of said sidewalls, and in which the outer parts of said bearings elements are bearing surfaces lying generally on an imaginary circle the diameter of which is somewhat smaller than the inner diameter of said core.

4. The invention as claimed in claim 3, in which said bearing elements are not equally spaced about said imaginary circle.

5. The invention as claimed in claim 1, in which there are at least three of said bearing elements on each of said sidewalls, in which the outer parts of said bearing elements are bearing surfaces lying generally on an imaginary circle the diameter of which is somewhat smaller than the inner diameter of said core, in which said bearing elements are not equally spaced about said imaginary circle, there being two of said bearings elements on each sidewall that are relatively adjacent said top wall, and one of said bearing elements on each sidewall that is relatively adjacent said bottom opening, and in which said dispensing opening means is sufficiently large that it may receive parts of mold means that simultaneously form said wall means and said bearing elements.

6. The invention as claimed in claim 1, in which said bearing elements are formed of synthetic resin and are integral with said wall means.

7. The invention as claimed in claim 1, in which said bearing elements are shaped with outer bearing regions adapted to have the inner cylindrical surface of said core slide thereon during dispensing of tape from said roll, and are also shaped with inclined cam regions adapted to cam said sidewalls apart when engaged by side portions of the tape roll during insertion or removal of said tape roll into said chamber to flex portions of said sidewalls and spread such sidewall portions apart, said sidewall portions then moving towards each other when said tape roll is in position for insertion of said bearing elements therein.

8. The invention as claimed in claim 1, in which said dispenser is combined with said roll of packaging tape, in which said sidewalls are sufficiently far apart that said roll is loose and free therebetween, and in which said elements are located and sized to be loose and free fit relative to the inner cylindrical surface of the core of said roll.

9. A dispenser for packaging tape, comprising:

(a) wall means to define a chamber sized to loosely receive a roll of packaging tape, said wall means being formed of synthetic resin, said wall means including opposed sidewalls that are generally parallel to each other, said sidewalls being sufficiently thin to be flexible and elastic, said sidewalls having large openings therein, a portion of said wall means between said sidewalls having an opening therein, said opening being so located and sized that said tape roll may be passed therethrough, in a direction parallel to said sidewalls, to a position in said chamber between said sidewalls, (b) bearing elements mounted on said opposed sidewalls and extending inwardly therefrom, said bearing elements being adapted to extend part way into the opening in the core of said tape roll, and to provide bearing support for said roll as tape is dispensed therefrom, the amount of said inward extension of said bearing elements being sufficiently small that, when said sidewalls are manually flexed apart, said tape roll may be inserted through said opening into said chamber, said tape roll passing between the inner portions of said bearing elements, said bearing elements penetrating, after said flexed sidewalls resume their unflexed conditions, into the opening in the core of said tape roll, said bearing elements being shaped with outer bearing regions adapted to have the inner cylindrical surface of said core slide thereon during dispensing of tape from said roll, said bearing elements also being shaped with inclined cam regions adapted to cam said sidewalls apart during insertion or removal of said tape roll or its core, said openings in said sidewalls being substantially smaller in diameter than is the opening in the core of said tape roll, there being a plurality of bearing elements on each of said sidewalls, said bearing elements being integral with said sidewalls and arranged around said openings in said sidewalls, said inclined cam regions converging toward said openings in said sidewalls, (c) dispensing opening means in said wall means, through which tape may be dispensed from said roll, and (d) means on said wall means to sever the tape after a length of tape has been dispensed from said roll.

10. A dispenser for packaging tape, comprising:

(a) wall means to define a chamber sized to loosely receive a roll of packaging tape, said wall means being formed of synthetic resin, said wall means including opposed sidewalls that are generally parallel to each other, and front and rear walls connecting said sidewalls, said sidewalls being sufficiently thin to be flexible and elastic, a portion of said wall means between said sidewalls having an opening therein, said opening being so located and sized that said tape roll may be passed therethrough, in a direction parallel to said sidewalls, to a position in said chamber between said sidewalls, (b) bearing and cam means mounted on said opposed sidewalls and extending inwardly therefrom, (said bearing and cam means being adapted to extend part way into the opening in the core of said tape roll, and to provide bearing support for said roll as tape is dispensed therefrom, the amount of said inward extension of said bearing and cam means being sufficiently small that, when said sidewalls are manually flexed apart, said tape roll may be inserted through said opening into said chamber, said tape roll passing between the inner portions of said bearing and cam means, said bearing and cam means penetrating, after said flexed sidewalls resume their unflexed conditions, into the opening in the core of said tape roll, said bearing and cam means being shaped with inclined cam regions adapted to cam said sidewalls away from each other during insertion of removal of said tape roll or its core, the amount of movement of said sidewalls away from each other being sufficient to permit passage of said tape roll or its core therepast, said sidewalls then moving toward each other due to their elasticity, to cause said bearing and cam means to penetrate into said core opening, (c) dispensing opening means in said wall means, through which tape may be dispensed from said roll, and (d) means on said wall means to sever the tape after a length of tape has been dispensed from said roll.

11. The invention as claimed in claim 10, in which at least one of said sidewalls has a large opening therein, said last-mentioned opening being inward of said bearing and cam means, said last-mentioned opening being adapted to receive fingers of the operator whereby the operator may engage the interior surface of said core of said tape roll, said bearing and cam means being a sufficiently loose fit relative to said core of said tape roll that when said tape roll is mounted thereon the operator, by engaging his or her fingers with said interior core surface, shift said tape roll into braking relationship with said wall means.

12. The invention as claimed in claim 10, in which said bearing and cam means is formed of synthetic resin and is integral with said wall means, and in which said dispensing opening means is sufficiently large to receive one mold element forming said bearing and cam means.

13. The invention as claimed in claim 10, in which said means on said wall means to sever the tape after a length of tape has been dispensed from said roll comprises a metal blade embedded in said wall means in a plane generally perpendicular to the direction of feeding of said tape from said dispenser, and in which said dispenser has a serrated wall portion disposed between said blade and said dispensing opening means to prevent sticking of the tape to said dispenser, said serrated portion being formed of synthetic resin and being integral with said wall means.

14. The invention as claimed in claim 13, in which a synthetic resin flange is formed integrally on said wall means between said serrated wall portion and said dispensing opening means, to cooperate with said serrated wall portion in preventing sticking of said tape to said dispenser.

15. The invention as claimed in claim 10, in which a roll of packaging tape is disposed in said chamber, being rotatably mounted on said bearing and cam means.

16. A dispenser for packaging tape, comprising:

(a) opposed substantially parallel sidewalls spaced apart sufficiently far that a roll of packaging tape may be disposed therebetween without binding relative to those sidewall surfaces nearest the opposite sidewalls, said sidewalls being formed of synthetic resin, (b) wall means extending between peripheral regions of said sidewalls to hold said peripheral regions substantially fixed relative to each other except at at least one portion thereof, said one portion being a large opening recited below, said sidewalls and said wall means forming a polyhedron, said wall means being formed of synthetic resin, (c) a large opening formed in said wall means, said large opening being sufficiently large to receive a roll of packaging tape when said roll is in full and unused condition, said large opening being so located and sized that said tape roll may be passed therethrough, in a direction parallel to said sidewalls, to a position in a chamber that is defined between said sidewalls, (d) bearing elements mounted on said opposed sidewalls and extending inwardly therefrom, said bearing elements being adapted to extend part way into the opening in the core of said tape roll, and to provide bearing support for said roll as tape is dispensed therefrom, the amount of said inward extension of said bearing element being sufficiently small that, when said sidewalls are manually flexed apart, said tape roll may be inserted through said large opening in said chamber, said tape roll passing between the inner portions of said bearing elements, said bearing elements penetrating, after said flexed sidewalls resume their unflexed conditions, into said opening in sad core of said tape roll, (e) dispensing opening means in said wall means, said dispensing opening means being a relatively small opening through which tape may be pulled from said tape roll and thus cause said tape roll to rotate on said bearing means, and (f) means on said wall means to sever said tape after a length of tape has been dispensed from said tape roll.

* * * * *